US005575083A

United States Patent [19]

Lee et al.

[11] Patent Number: 5,575,083

[45] Date of Patent: Nov. 19, 1996

[54] VACUUM DRYER

[75] Inventors: In S. Lee; Hyeong K. Lee, both of Kyungki-do, Rep. of Korea

[73] Assignee: Goldstar Co., Ltd., Seoul, Rep. of Korea

[21] Appl. No.: 266,887

[22] Filed: Jul. 5, 1994

[30] Foreign Application Priority Data

| | | | |
|---|---|---|---|
| Jul. 5, 1993 | [KR] | Rep. of Korea | 12535/1993 |
| Jul. 13, 1993 | [KR] | Rep. of Korea | 12843/1993 |
| Jul. 23, 1993 | [KR] | Rep. of Korea | 14040/1993 |

[51] Int. Cl.[6] ..... F26B 3/34

[52] U.S. Cl. ..... 34/255; 34/73; 34/78

[58] Field of Search ..... 34/92, 73, 255, 34/257, 398, 407, 408, 412, 386, 388, 78

[56] References Cited

U.S. PATENT DOCUMENTS

| | | | |
|---|---|---|---|
| 1,726,373 | 8/1929 | Voightlander | 34/398 X |
| 2,325,652 | 8/1943 | Bierwirth | 34/257 |
| 3,538,616 | 11/1970 | Malling | 34/92 |
| 4,194,296 | 3/1980 | Pagnozzi et al. | 34/92 X |
| 4,426,793 | 1/1984 | Kuboyama | 34/92 X |
| 4,466,198 | 8/1984 | Doll | 34/92 X |
| 4,525,935 | 7/1985 | Stuhmeier et al. | 34/398 |
| 5,353,519 | 10/1994 | Kanamaru et al. | 34/92 |
| 5,377,425 | 1/1995 | Kawakami et al. | 34/92 |

*Primary Examiner*—Edward K. Look
*Assistant Examiner*—Hoang Nguyen

[57] ABSTRACT

This invention relates to a compact vacuum dryer for quickly and economically drying objects such as grain, industrial raw materials and thrash. The vacuum dryer includes a combined upper and lower chamber for accommodating the drying objects. A vacuum pump is connected to the upper chamber for drawing in air for creating the vacuum within the system. A direct heating apparatus is provided at one side of the combination of the upper and lower chambers to directly heat the drying objects. A dielectric heating apparatus indirectly heats the drying objects in combination with direct heating apparatus. A moisture removing apparatus is provided along a discharge passage between the upper chamber and the vacuum pump for preventing the vacuum pump from drawing in moisture from the chamber which may damage or disable the pump.

9 Claims, 3 Drawing Sheets

VACUUM DRYER

FIELD OF THE INVENTION

This invention relates to a vacuum dryer, more particularly to a vacuum dryer which is made compact and can quickly dry objects, such as grain, industrial raw materials and thrash.

BACKGROUND OF THE INVENTION

FIG. 1 is a schematic drawing of one example of a conventional vacuum dryer including an upper chamber 21 and a lower chamber 31 made to communicate with each other. A thermal cycle is formed through the upper chamber 21 and lower chamber 31 using a compressor 24, a condenser 25, an expansion valve 26 and an evaporator 27. A vacuum pump 22 is connected to one side of the upper chamber 21 through a discharge pipe 23.

The evaporator 27 is positioned within the upper chamber 21, while the condenser 25 is positioned within the lower chamber 31. The compressor 24 and the expansion valve 26 are located outside of the two chambers 21 and 31.

With such a construction, an object to be dried is introduced into the lower chamber 31 through an opening therein (not shown) and power is turned on. The thermal cycle begins as the vacuum pump 22 is activated. Once the vacuum pump 22 as connected to the discharge pipe 23 has been activated, air is discharged from inside of the combination of the upper chamber 21 and lower chamber 31 through the discharge pipe 23. A vacuum is maintained in the upper chamber 21 and the lower chamber 31 during the drying process. In this condition, the compressor 24 within the thermal cycle continuously circulates a refrigerant or other comparable fluid through the system including the condenser 25, the expansion valve 26 and the evaporator 27.

When the thermal cycle is created, the condenser 25 discharges heat into the lower chamber 31, and the evaporator 27 absorbs heat from the upper chamber 21. Accordingly, due to the heat exchange within the two chambers, the temperature within the lower chamber 21 can be maintained within a range of about 40° C. to 50° C., and the temperature within the upper chamber 21 can be maintained at approximately 5° C. Therefore, moisture can be evaporated from objects disposed in the lower chamber 31, condensed in the upper chamber 21, and discharged to outside the dryer by the vacuum pump 22.

Conventional vacuum dryers, as described above, have certain disadvantages. First, the conventional vacuum dryer has a complicated construction. Second, it is expensive to operate due to the cost of creating the thermal cycle for heat exchange in the chambers and the cost of transporting the dried material from the lower chamber because the volume of the dried material cannot be reduced significantly.

SUMMARY OF THE INVENTION

A principal object of the present invention is the production of a vacuum dryer, and more particularly, a compact vacuum dryer that can quickly dry objects, such as grain, industrial raw material and thrash.

This and other objects and features of this invention can be achieved by providing a vacuum dryer including the combination of an upper chamber and a lower chamber drying objects. A vacuum pump is connected to the upper chamber for drawing in air. A direct heating means is provided at one side of the combination of the upper and lower chambers for directly heating the drying objects. A dielectric heating means for indirectly heating drying objects is also provided. A moisture removing means is positioned between the upper chamber and the vacuum pump for preventing the vacuum pump from drawing in moisture from the drying objects.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and, thus, are not limitative of the present invention, and wherein.

DETAILED DESCRIPTION OF THE PREFERRED EMBODIMENT

Various embodiments of the invention will be explained in detail hereinafter, with reference to FIGS. 2 through 5. To prevent confusion in explaining the various embodiments of the invention, parts having the same construction and function will be represented with same reference numbers.

Figure 1:
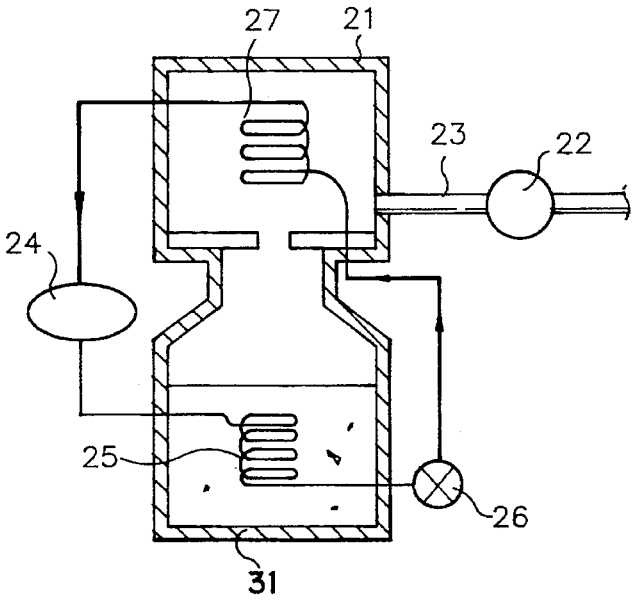
FIG. 1 PRIOR ART
FIG. 1 is a schematic drawing of a conventional vacuum dryer.
Figure 2:
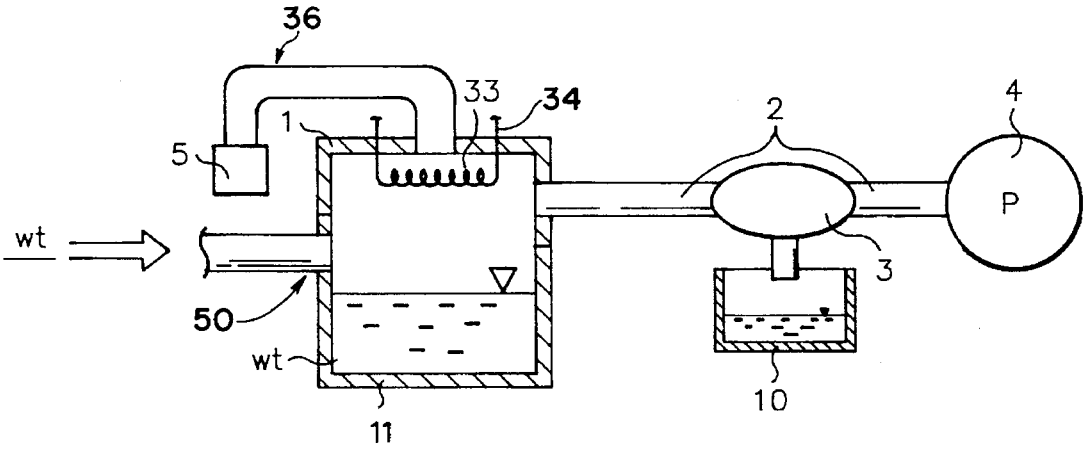
FIG. 2 is a schematic drawing of a vacuum dryer in accordance with one embodiment of this invention.

FIG. 2 illustrates a vacuum dryer in accordance with a first embodiment of the invention. The vacuum dryer includes an upper chamber 1 and a lower chamber 11. The lower chamber 11 is detachably mounted to the upper chamber 5 for forming a single chamber to accommodate objects to be dried. Both the upper and lower chambers, 1 and 11, are heat insulated. A vacuum pump 4 is connected to the upper chamber 1 for drawing in air from the connected chambers 1 and 11. A direct heating means 33 is provided at one side of the chambers 1 and 11 for heating objects to be dried. A moisture removing means 2 is provided between the upper chamber 1 and the vacuum pump 4 for preventing the vacuum pump 4 from drawing in moisture from the drying objects once evaporated by the direct heating means 33.

The dryer shown in FIG. 2 has two drying mechanisms which work together to make the drying process more efficient. The direct heating means 33 includes an electric heater 34 provided within the upper chamber 1. The dielectric heating means 36 has an oscillator 5 for generating high frequency and a defined length of feeding pipe 6 for feeding the high frequency generated in the oscillator 5 into the chambers 1 and 11.

There is also a device for protecting the vacuum from damage by moisture from the drying object. The moisture removing means 2 has a dryer 3 for extracting moisture from air passing through the discharge pipe 32 toward the vacuum pump 4 into a container 10 for accommodating moisture filtered in by the dryer 3.

With foregoing construction, the dryer of FIG. 2 operates as follows. Drying objects (Wt) soaked with liquid are introduced into the heat insulated upper and lower chambers 1 and 11, respectively, through an opening 50 formed at one side of the lower chamber 31. As the power is turned on, the interior of the combined upper and the lower chambers, 1 and 11, is heated rapidly by heat radiated from the electric heater 33 and high frequency from the oscillator 5. As the temperature inside of the combined upper and lower chambers 1 and 11 rises, moisture evaporates from the drying objects (Wt) in the combined upper and the lower chamber 1 and 11, and the evaporated moisture is discharged to outside of the chambers through a discharge pipe 32 connected to one side of the upper chamber 1.

Moisture discharged together with the air from the chambers 1 and 11 through the discharge pipe 32 by the vacuum pump 4 is condensed by the dryer 3 and collected in the container 10. Thus, the vacuum pump 4 is prevented from drawing in moisture. Moisture entering the vacuum pump 4 may shorted the life or disable the vacuum pump 4.

Figure 3:
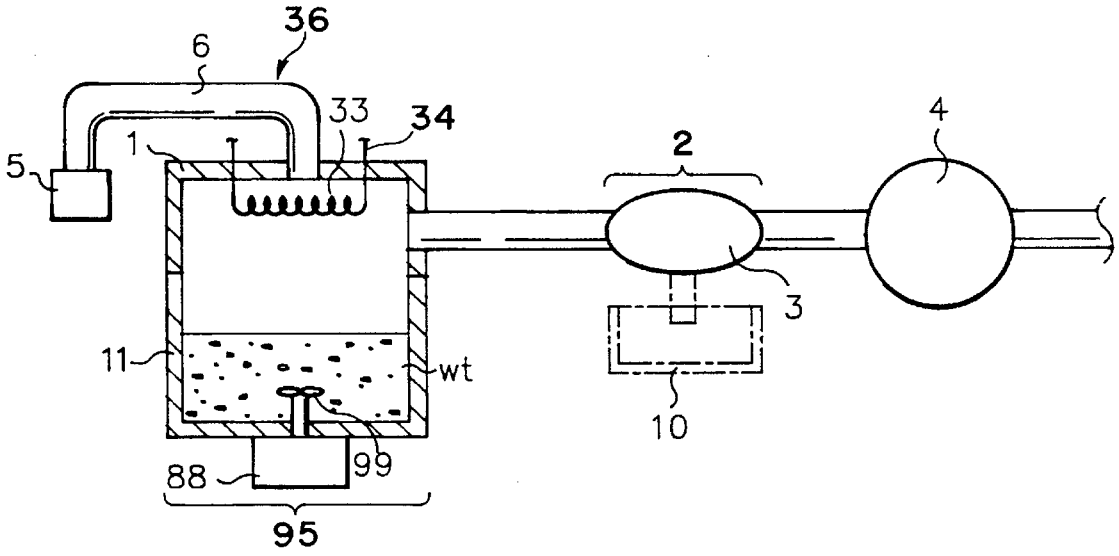
FIG. 3 is a schematic drawing of a vacuum dryer in accordance with another embodiment of this invention.

A second embodiment of this invention is shown in FIG. 3. This embodiment further includes an agitating means 95 accommodated in the lower chamber 11 for agitating objects to be dried. The agitating means has a motor 88 positioned on an exterior surface of the lower chamber 11 and a fan 99, within the lower chamber 11, rotated by the driving force of the motor 88.

With the foregoing construction, when drying objects (Wt) within the combined chambers 1 and 11, the fan 99 provided in the lower chamber 11 agitates the drying objects (Wt) helping heat generated by the electric heater 33 and the high frequency generated by the oscillator 5 to reach the circulating objects. The second embodiment of this invention promotes drying especially when the drying objects (Wt) consist of several small pieces.

Figure 4:
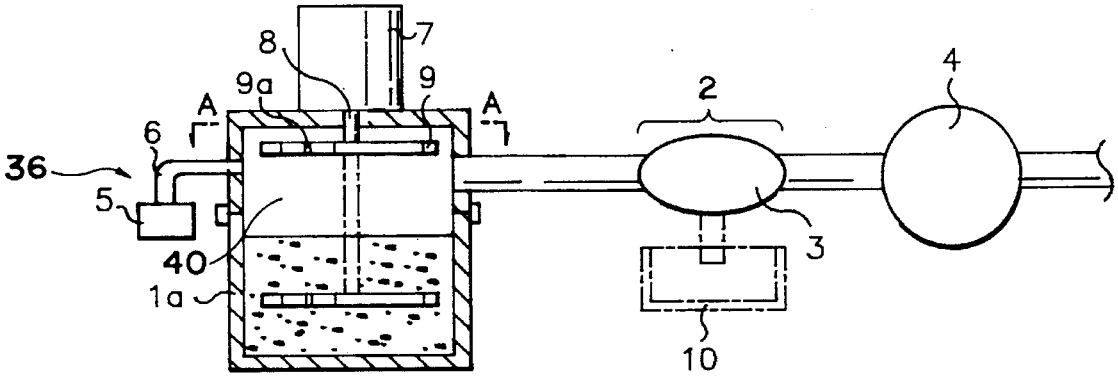
FIGS. 4 and 5 are schematic drawings of a vacuum dryer in accordance with still another embodiment of this invention.

A third embodiment of this invention is shown in FIG. 4. That dryer further includes a compression means 40 for compressing drying objects accommodated in the chambers 1 and 11.

Figure 5:
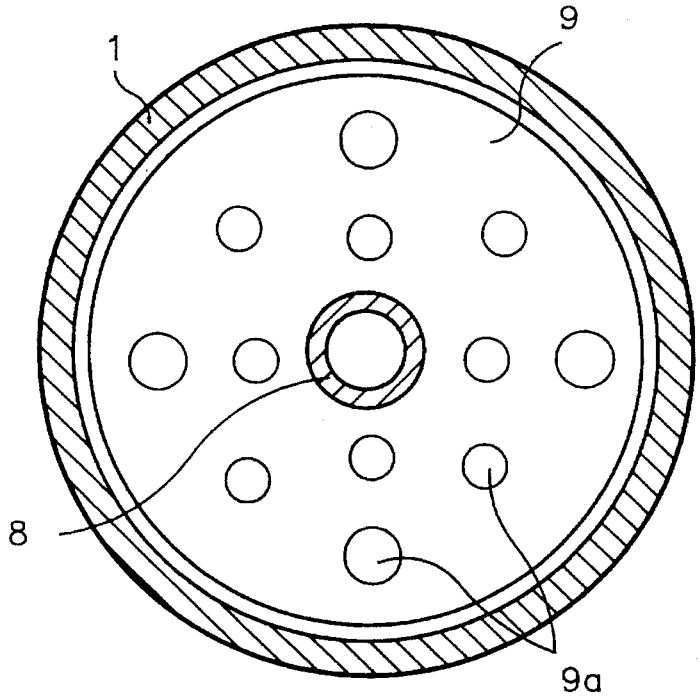

The compression means 40 has a motor 7 positioned on an exterior surface of the upper chamber 1 for causing a moving shaft 8 mounted on the motor 7 to move vertically forward and backward. A compression plate 9 fixed at an end of the moving shaft 8 compresses the drying objects in the combined upper and lower chambers 1 and 11 when the moving shaft 8 advances. As shown in FIG. 5, the compression plate 9 has holes **9*a*** for allowing fluid to escape from the drying objects being compressed allowing the high frequency to better perform the drying operation.

With the foregoing construction, when the drying objects (Wt) in the combined chambers 1 and 11 are dried, the drying and compression operations are performed at the same time.

One of the benefits of compressing the drying objects in the combined upper and lower chambers 1 and 11 using the compression plate 9 is for decreasing the volume of the drying objects (Wt) as well as for helping moisture to escape from the drying objects and closer to the heating device. As shown in FIG. 4 moisture contained in the drying objects can escape smoothly through a plurality of holes **9*a* in the compression plate 9 and the high frequency generated in the oscillator 5 can be delivered to the drying objects (Wt) through the plurality of holes 9*a***. As a result, the period for drying the drying objects (Wt) can be shortened. This is especially true when drying objects (Wt) that require compression such as thrash.

This invention having the foregoing operation has following advantages over conventional dryers. First, the vacuum dryer of this invention has a simple construction. The cost of operation is low since it has a faster drying speed because an electric heater and a high frequency oscillator are used for heating the inside of the combined chambers. Second, the vacuum dryer of this invention can reduce the cost of transporting the dried objects, because the dryer decreases the volume of the objects significantly by removing the moisture from the objects and by reducing the occupied space by using the compression mechanism.

Although the invention has been described in conjunction with specific embodiments, it is evident that many alternatives and variations will be apparent to those skilled in the art in light of the foregoing description.

Accordingly, the invention is intended to embrace all of the alternatives and variations that fall within the spirit and scope of the appended claims.

What is claimed is:

1. A vacuum dryer comprising:

an upper chamber;

a lower chamber, detachably mounted in communication with the upper chamber for accommodating objects to be dried;

a vacuum pump, connected to the upper chamber by a conduit, for drawing in air to create a vacuum within the combination of said upper and lower chambers;

a direct heating means positioned on the upper chamber for directly heating objects to be dried within the combination of the upper and lower chambers;

a dielectric heating means for heating the objects to be dried in areas of the combination of the upper and lower chambers remotely located from the direct heating means; and, a moisture removing means, provided along the conduit between the upper chamber and the vacuum pump, for removing moisture from the air drawn by the vacuum pump originating from the combination of the upper and lower chambers.

2. The vacuum dryer as recited in claim 1, further including an agitating means provided in the combination of the upper and lower chambers for agitating drying objects accommodated therein to facilitate drying.

3. The vacuum dryer as recited in claim 1, wherein the direct heating means includes an electric heater provided in the combination of upper and lower chambers.

4. The vacuum dryer as recited in claim 1, wherein the dielectric heating means includes an oscillator for generating high frequency signals and a feeding pipe for feeding the high frequency signals into the combination of the upper and lower chambers.

5. The vacuum dryer as recited in claim 1, wherein the moisture removing means includes a condenser for extracting moisture from air and a container for collecting the moisture removed from the air by the condenser.

6. The vacuum dryer as claimed in claim 2, wherein the agitating means includes a motor positioned on an exterior surface of the lower chamber and a fan rotatably connected to the motor located within an interior portion of the combination of the upper and lower chambers.

7. A vacuum dryer comprising:

an upper chamber;

a lower chamber, detachably mounted in communication with the upper chamber for accommodating objects to be dried;

a vacuum pump, connected to the upper chamber by a conduit, for drawing in air to create a vacuum within the combination of said upper and lower chambers;

a dielectric heating means for heating the objects to be dried located in areas of the combination of the upper and lower chambers remotely located from the direct heating means;

a moisture removing means, provided along the conduit between the upper chamber and the vacuum pump, for removing moisture from the air drawn by the vacuum pump originating from the combination of the upper and lower chambers; and, a compression means provided in the combination of the upper and lower chambers for compressing object to be dried which are accommodated therein.

8. The vacuum dryer as claimed in claim 7, wherein the compression means includes a motor fixed to an exterior surface of the upper chamber for generating a rotating force, a shaft fixed to the motor for motion vertically forward and backward in response to operation of the motor, and a compression plate fixed at an end of the moving shaft opposite from the motor for compressing objects to be dried within the combination of the upper and lower chambers when the moving shaft moves forward.

9. The vacuum dryer as claimed in claim 8, wherein the compression plate includes a plurality of holes for allowing moisture to escape from objects being compressed.

* * * * *